US010480210B2

(12) United States Patent
Mouchet

(10) Patent No.: US 10,480,210 B2
(45) Date of Patent: Nov. 19, 2019

(54) SCREEN PANEL

(71) Applicant: INTERMAS NETS S.A., Llinars Del Valles (ES)

(72) Inventor: François Mouchet, Barcelona (ES)

(73) Assignee: INTERMAS NETS SA, Llinars Del Valles (ES)

( * ) Notice: Subject to any disclaimer, the term of this patent is extended or adjusted under 35 U.S.C. 154(b) by 84 days.

(21) Appl. No.: 14/912,230

(22) PCT Filed: Aug. 14, 2014

(86) PCT No.: PCT/IB2014/063920
§ 371 (c)(1),
(2) Date: Feb. 16, 2016

(87) PCT Pub. No.: WO2015/022665
PCT Pub. Date: Feb. 19, 2015

(65) Prior Publication Data

US 2016/0201352 A1 Jul. 14, 2016

(30) Foreign Application Priority Data

Aug. 14, 2013 (FR) ..... 13 58029

(51) Int. Cl.
*E04H 17/16* (2006.01)
*E04H 17/20* (2006.01)
(Continued)

(52) U.S. Cl.
CPC ..... *E04H 17/165* (2013.01); *E04H 17/168* (2013.01); *E04H 17/20* (2013.01);
(Continued)

(58) Field of Classification Search
CPC ..... E04H 17/168; E04H 2017/1452; E04H 17/20; E04H 17/165; E04B 2/7416; E06B 9/24
(Continued)

(56) References Cited

U.S. PATENT DOCUMENTS 3,273,862 A * 9/1966 Miller ..... A47D 13/06 160/354
4,193,584 A * 3/1980 Wieser ..... A01K 1/0005 119/513
(Continued)

FOREIGN PATENT DOCUMENTS

EP 1156178 A2 11/2001
GB 2297336 A 7/1996

OTHER PUBLICATIONS

Dec. 4, 2014 Search Report issued in International Patent Application No. PCT/IB2014/063920.
(Continued)

*Primary Examiner* — Amber R Anderson
*Assistant Examiner* — Nahid Amiri
(74) *Attorney, Agent, or Firm* — Oliff PLC

(57) ABSTRACT

A screen panel intended to be mounted on or fixed to a surface, in particular to ensure a "screen" effect, includes a sheet, preferably rectangular, that is held by its edges in a rigid frame, preferably metallic, that includes joined-together profiled elements. The frame includes two uprights that are able to be placed on or fixed to a surface, having at least one groove on the inside, the uprights being joined to cross members by assembly parts in the form of an angle bracket that is inserted in each case into a groove in a corresponding upright by way of one bearing surface and into a groove in a corresponding cross member by its other, preferably orthogonal bearing surface.

21 Claims, 4 Drawing Sheets

(51) Int. Cl.
*E06B 9/24* (2006.01)
*E04B 2/74* (2006.01)
*E04H 17/14* (2006.01)

(52) U.S. Cl.
CPC ..... *E06B 9/24* (2013.01); *E04B 2/7416* (2013.01); *E04H 2017/1452* (2013.01)

(58) Field of Classification Search
USPC ..... 256/24, 65.01, 65.02, 65.08, 65.14, 73; 52/780, 781, 656.1, 656.9
See application file for complete search history.

(56) References Cited

U.S. PATENT DOCUMENTS 4,545,142 A * 10/1985 Whisnant ..... E04B 2/7425 40/605
4,809,955 A * 3/1989 Veilleux ..... E04F 11/181 256/19
4,928,465 A * 5/1990 Del Castillo Von Haucke ..... E04B 2/7437 160/135
5,069,263 A * 12/1991 Edwards ..... A47G 5/00 160/135
5,261,756 A * 11/1993 Kohn ..... F16B 7/0413 403/292
7,216,855 B2 * 5/2007 Platt ..... E04H 17/1421 256/65.02
7,478,797 B2 * 1/2009 Laws ..... E04H 17/168 256/19
8,549,779 B2 * 10/2013 Ceurvels ..... G09F 15/0068 160/113
9,149,894 B2 * 10/2015 Richison ..... B23P 11/00
2002/0139079 A1 * 10/2002 Brady ..... E04B 2/7457 52/653.1
2006/0192190 A1 * 8/2006 Brucker ..... E04H 17/16 256/24
2007/0145340 A1 * 6/2007 Brabeck ..... E04H 17/163 256/24
2007/0163189 A1 * 7/2007 Venegas, Jr. ..... F41H 5/24 52/222
2008/0277639 A1 11/2008 Huang
2009/0003928 A1 * 1/2009 Ohrstrom ..... E06B 3/9647 403/205
2011/0233496 A1 * 9/2011 Caruso ..... E04H 17/168 256/24

OTHER PUBLICATIONS

Dec. 4, 2014 Written Opinion issued in International Patent Application No. PCT/IB2014/063920.

* cited by examiner

SCREEN PANEL

The present invention relates to a screen panel designed to be mounted or fixed on a surface, in particular to act as a "visual obstruction".

Such panels usually comprise a sheet made of plastic material, with an openwork structure, held by its edges in a rigid metallic frame consisting of assembled profiles, in particular U-section profiles.

Conventionally, this frame, so as to be held in a vertical position, is fixed to uprights with the aid of assembly elements, generally of the nut-and-bolt type.

Such panels, which are generally rectangular in shape, for example 1 meter by 2 meters, make it possible to partition off a terrace when they are arranged with their long sides in the vertical position, or to top a low wall when they are arranged with their long sides in the horizontal position. They may also be fixed on a wall so as to provide a decorative effect or to form a trellis for plants.

The sheet, conventionally made of plastic material, is immobilized in the rigid metallic frame which surrounds it such that it is possible to see deformations of the plastic sheet as a consequence of the differences between the coefficients of expansion of the sheet made of plastic material and of the frame surrounding it.

This spoils the visual appearance of the screen panel which deteriorates over time.

There is therefore a need for a screen panel which is able to avoid deformations of the sheet.

Furthermore, there is a permanent need for a screen panel which is quick and easy to install.

One object of the present invention is to provide a screen panel that at least partially meets these requirements.

The object of the present invention is to create a screen panel of simple structure which requires no nut-and-bolt assembly elements and which makes it possible to avoid deformations of the sheet, preferably made of plastic material, in spite of the differences in coefficients of expansion with respect to the metallic frame surrounding it.

The screen panel according to the invention is characterized essentially in that the frame comprises two uprights able to be placed or fixed on a surface and consisting of preferably metallic, preferably hollow and preferably square-section profiles, each upright comprising internally at least one, preferably at least two, and preferably three, channels, which are preferably orthogonal and preferably defined by elastically deformable walls, the uprights being connected to crosspieces, which preferably consist of preferably metallic profiles, by assembly parts in the form of a bracket each engaging with one arm in a channel of a corresponding upright and with its other, orthogonal, arm in a channel of a corresponding crosspiece.

Preferably, the channel of an upright and/or the channel of a crosspiece, into which the sheet is inserted, is/are formed so as to allow a deformation of the sheet, in particular under the effect of the expansion. To that end, a channel may comprise a depth which allows a gap to remain between the bottom of the channel and the edge of the sheet inserted therein. This gap may be greater than 0.5 mm, or even greater than 1 mm. Preferably, said channel is defined by elastically deformable walls, that is to say that the channel is capable of opening under the effect of an increase in the thickness of the sheet inserted therein, as a consequence in particular of an expansion of said sheet.

Preferably, the upright comprises at least one channel orthogonal to the channel receiving the assembly part and the sheet. Advantageously, this orthogonal channel improves the elastic deformability of the walls of the channel receiving the assembly part and the sheet.

Preferably, at least one, preferably all, of the bracket-shaped assembly parts are essentially flat. Preferably their thickness is less than 20 mm, preferably less than 15 mm, preferably less than 10 mm.

In one embodiment, the thickness of a bracket-shaped assembly part is less, at least in the part which enters a channel, or even at all points, than the width of the channel.

Preferably however, the thickness of a bracket-shaped assembly part is greater, at least in the partie which enters a channel, preferably at all points, than 1.02 times, preferably 1.05 times, or even 1.10 times the width of said channel. Advantageously, the assembly part is thus force-fitted in the channel receiving it. Preferably, however, the thickness of a bracket-shaped assembly part is at all points less than 1.5 times, preferably 1.3 times, preferably 1.2 times the width of the channel receiving it.

It is understood that, according to the invention, it is the uprights which form part of the frame and bear on or attach to the ground. The bracket-shaped assembly parts connect the uprights to the crosspieces without the need for parts such as nuts and bolts. The number of parts is thus advantageously limited.

The hollow metallic profiles forming the uprights and/or the crosspieces are preferably made in one piece by bending a metal sheet so as to create the internal channels.

Preferably, the channel of an upright which receives a bracket-shaped assembly part is the same as that which receives the sheet made of plastic material.

Preferably, the two crosspieces are joined in an identical manner to an upright, an assembly part in each case coming to engage in a channel of the crosspiece and in a preferably orthogonal channel of the upright.

Preferably, each assembly part is formed so as to fill the part of the channel of the corresponding upright which extends on the side opposite the sheet with respect to the crosspiece.

In one embodiment, the arm engaged in the channel of the upright is designed to act as a spacer, in particular so as to ensure a predetermined distance between the crosspiece and the end of the upright close to said crosspiece.

In a first embodiment, the crosspieces are made of the same hollow profiles as the uprights.

Such an embodiment is preferred for installing a rectangular screen panel with its long sides in the horizontal position, for example so as to create a screening surface 2 meters long by 1 meter high.

In a second embodiment, the crosspieces consist of profiles of a different type, for example in the shape of an H having two channels in line with one another, one of the channels receiving an edge of the sheet and the other receiving an arm of a bracket-shaped assembly part. Such an embodiment is preferred for installing rectangular screen panels, for example of one meter by two, with the long sides in the vertical position so as to create a screening surface which is two meters tall.

According to the invention, there is moreover preferably provided, for each of the uprights, a lower ground-bearing end piece, able to be attached, preferably by snap-fitting, to the end of an upright and/or an upper sealing end piece able to be attached, preferably by snap-fitting, to the opposite end of the upright.

Preferably, the lower ground-bearing end piece comprises attachment orifices designed to receive attachment screws.

Preferably, the lower ground-bearing end piece is formed so as to prevent, in cooperation with an assembly part, any movement of the lower cross piece toward said lower end piece. Similarly, preferably, the upper sealing end piece is formed so as to prevent, in cooperation with an assembly part, any movement of the upper cross piece toward said upper sealing end piece. Said assembly parts then advantageously serve as spacers and ensure a predetermined geometry for the screen panel.

Preferably, connecting the sheet to an upright requires no parts other than the crosspieces and the bracket-shaped assembly parts, and possibly the lower and upper end pieces. In particular, preferably, a screen panel according to the invention comprises neither screws nor nails for attaching the sheet to the uprights and/or to the crosspieces. Advantageously, the panel is particularly quick to assemble.

Preferably too, an assembly part comprises two arms (or "branches") extending essentially perpendicular to one another and preferably formed so as not to project when they are respectively inserted into a channel of the upright and into a channel of the crosspiece. Preferably, said arms are flush with the openings of said channels. This advantageously improves the appearance of the screen panel.

Preferably too, the two arms are connected by a stiffening rib. This rib also advantageously ensures a gradual transition between the upright and the crosspiece, in particular reducing the accumulation of dirt in the corner defined by the upright and by the crosspiece in which the assembly part is lodged.

In one embodiment, the assembly parts and/or the lower end piece and/or the upper end piece and/or the crosspieces are made of plastic material, for example of polymer resin.

The invention also relates to a screen comprising at least two, or even at least three, or even at least four, or even at least five, screen panels according to the invention and interconnected in pairs.

Preferably, the screen is such that at least two, or even at least three, or even at least four, or even at least five, or even all of the constituent screen panels are arranged in one and the same plane.

In order to show clearly the features of the present invention, there follows a non-limiting description of the embodiments, with reference to the appended drawing, in which.

Figure 1:
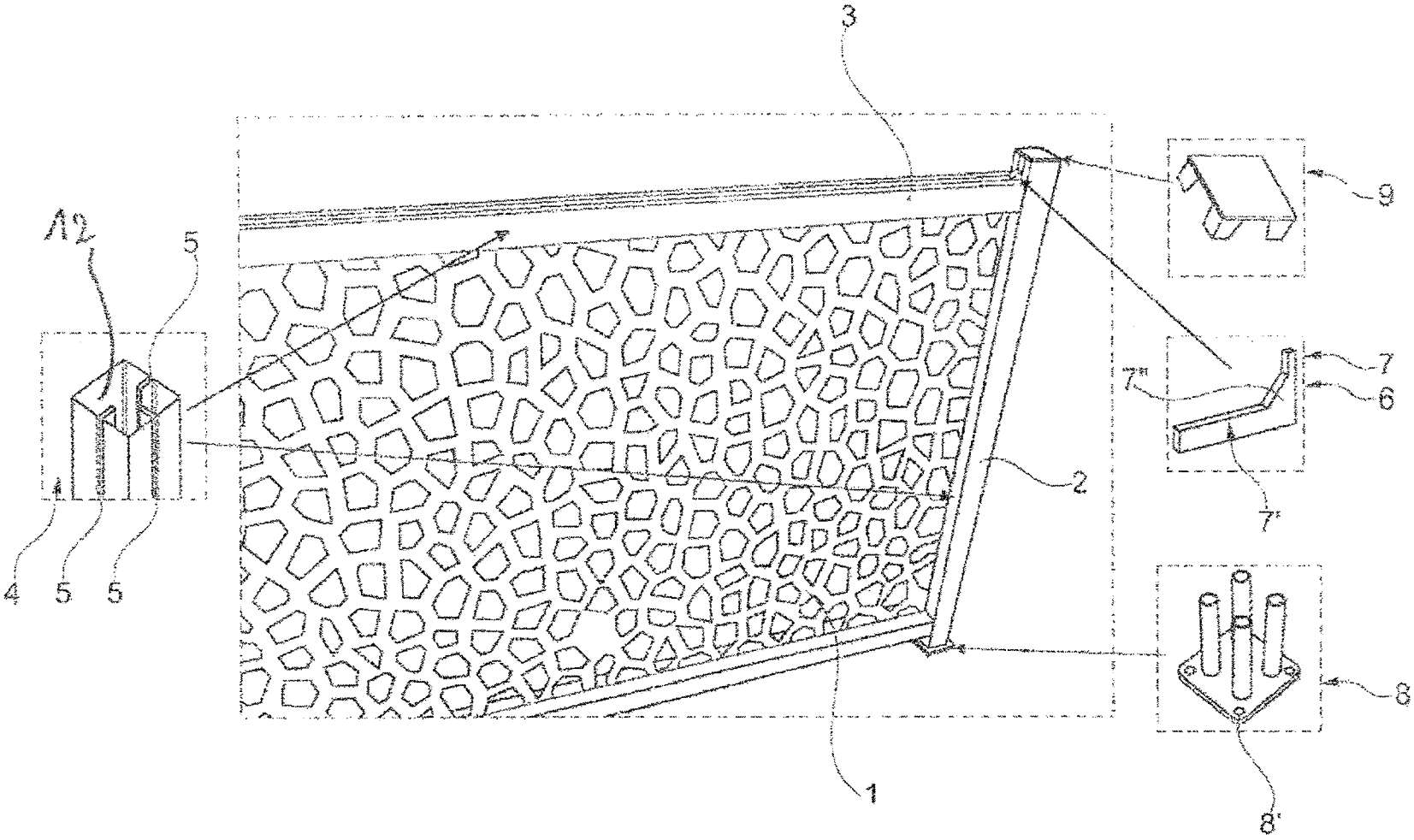
FIG. 1 shows a schematic, partial depiction of a first embodiment.

The screen panel such as that shown in FIG. 1 comprises a sheet 1, preferably made of plastic material, preferably having an openwork structure, made of injection molded copolymer or polymer resin.

The shape of the openings in the sheet 1 as shown is of course not limiting.

The uprights 2 and the crosspieces 3 consist of hollow metallic profiles 4 of which the cross section is visible in the left-hand part of FIG. 1. The profile 4 has a square cross section which is formed by bending a metal sheet and which defines three orthogonal internal channels 5 having elastically deformable walls.

Figure 3:
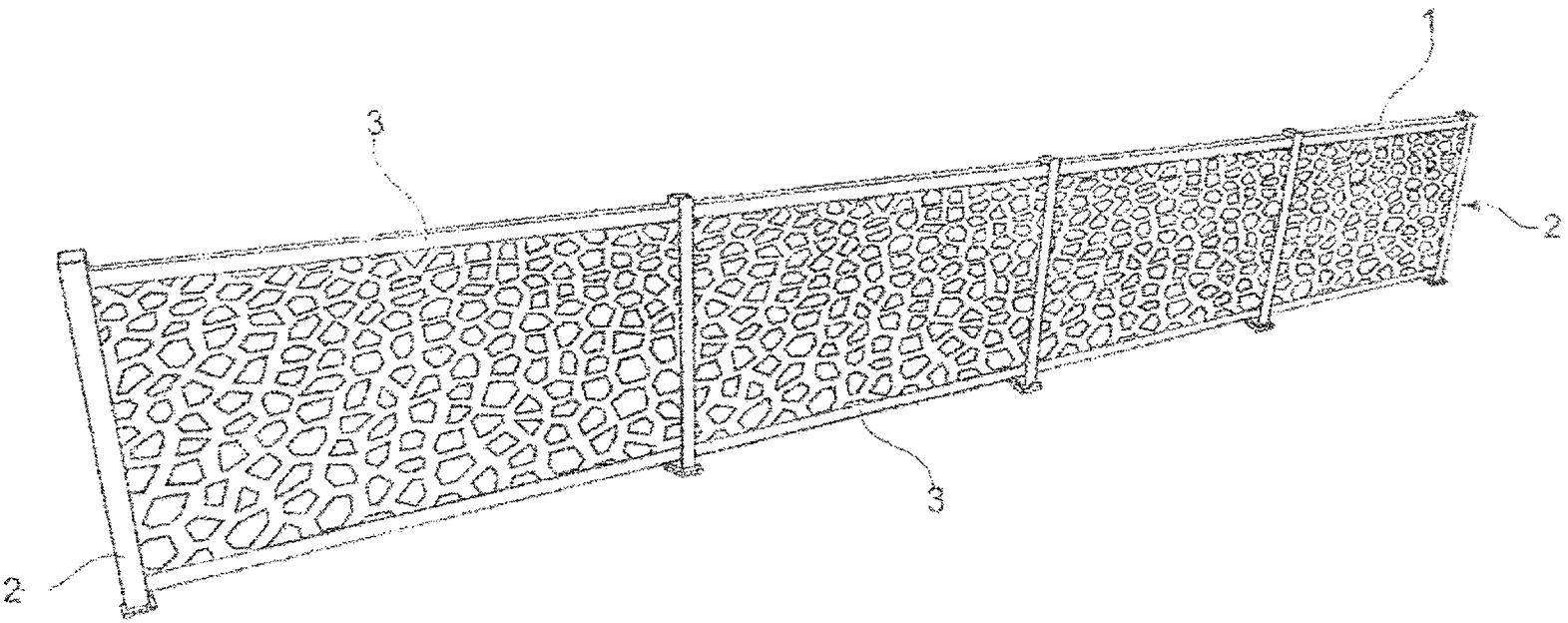
FIG. 3 shows a "visual obstruction" wall created from four screen panels as shown in FIG. 1.
Figure 4:
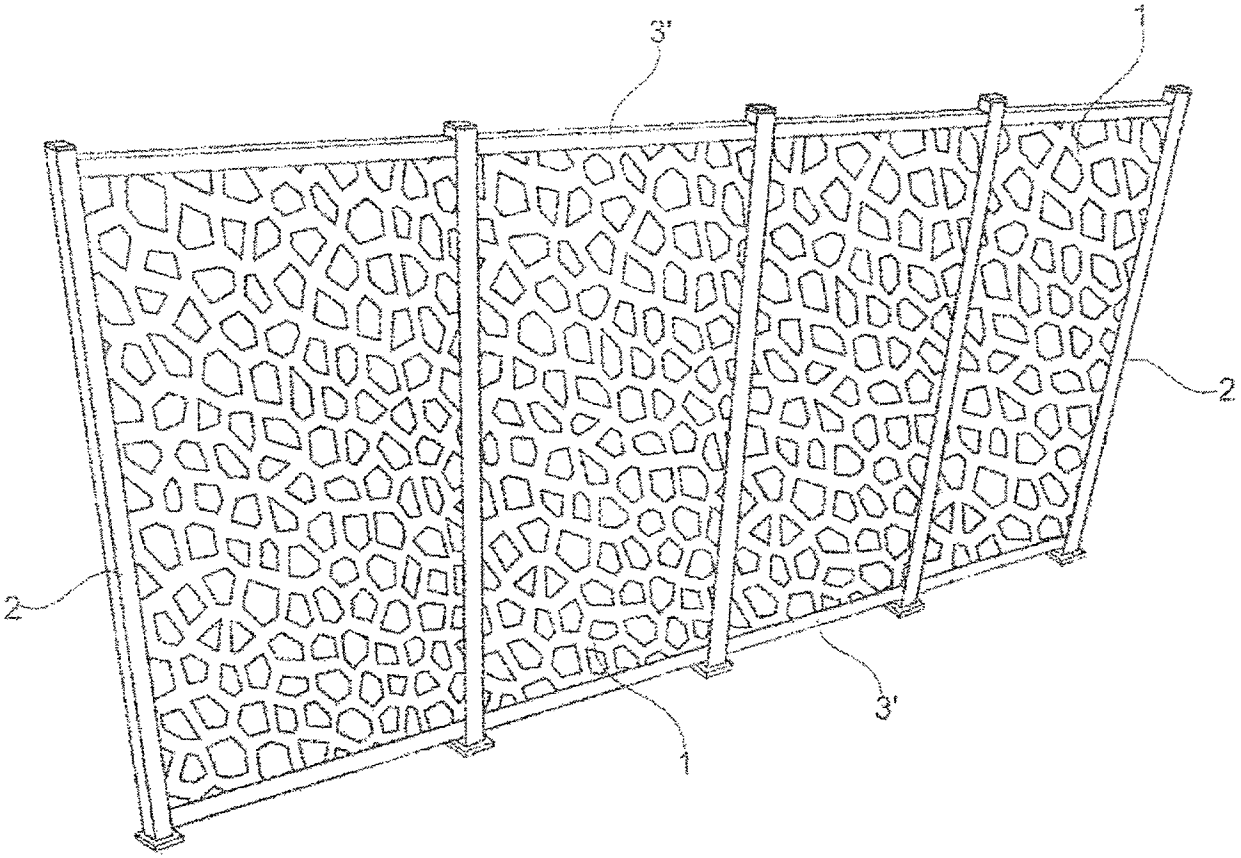
FIG. 4 is a view similar to FIG. 3 of a "visual obstruction" wall created from the screen panels as shown in FIG. 2.

One of the channels 5 is designed to house the sheet 1, the opposite channel being able to house the sheet of an adjacent panel as shown in FIGS. 3 and 4.

The channel 5 is designed to receive an arm 7 of an assembly part 6, which is shown in the right-hand part of FIG. 1, this assembly part 6 being in the form of a bracket and comprising two orthogonal arms 7 and 7' connected by a rib 7" which serves to increase the rigidity of the assembly part. The second arm 7' of the assembly part 6 is designed to be inserted into a channel of a crosspiece, the assembly part 6 thus connecting the upright to said crosspiece.

Preferably, at least one, preferably all, of the assembly parts are formed such that, once the screen panel is assembled, they are essentially hidden inside the channels of the corresponding uprights and crosspieces. Preferably, an assembly part does not project out from the channels of the corresponding upright and crosspiece or projects therefrom only by a rib connecting the two arms of the assembly part.

Preferably, the end face 12, 12' of a crosspiece and/or of an upright at least partially, and preferably fully, faces the side wall of an upright and/or of a crosspiece respectively, and is at a distance of less than 10 mm, preferably of less than 5 mm, preferably of less than 2 mm, from the upright and/or from the crosspiece respectively, or even is in contact therewith.

For bearing against or attaching to the ground, there is provided a lower end piece 8 for attachment which is able to be snapped-fitted to the lower end of the upright. This end piece comprises attachment openings 8' through which attachment means can pass into the ground.

Similarly, on the upper part of the upright, there is provided an upper sealing end piece 9 which forms a cap.

Figure 2:
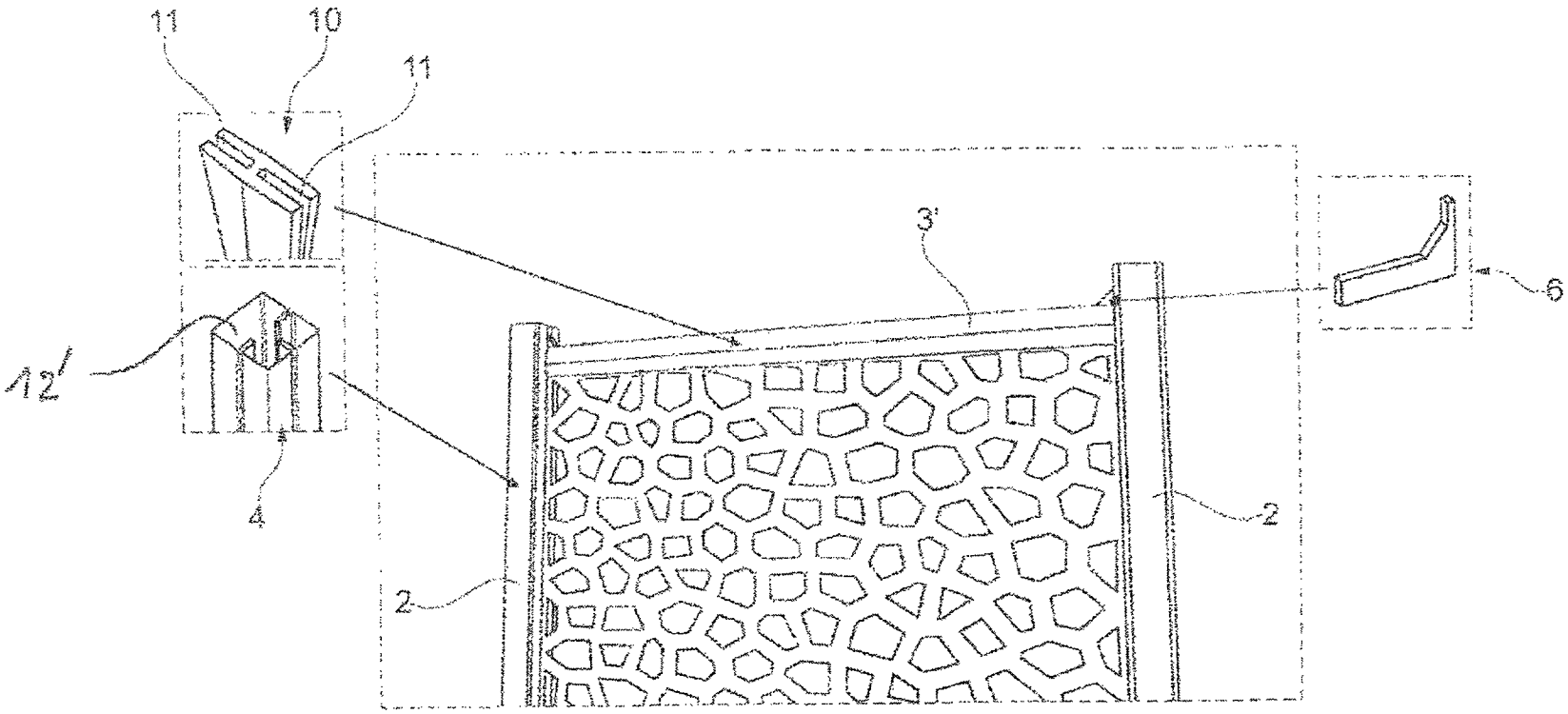
FIG. 2 shows a depiction, also schematic and partial, of a second embodiment of the invention.

The embodiment of FIG. 2 differs from that of FIG. 1 in that the crosspieces consist of H-shaped profiles 10, comprising two channels 11.

It is understood that the screen panel according to the invention is assembled in a very simple manner, without the need for any tools. The sheet made of plastic material 1 is put in place in the channels provided to that end in the uprights 2, then the sheet is inserted into the crosspieces 3 and 3'. The uprights 2 and the crosspieces 3 and 3' are immobilized with the aid of the assembly brackets 6 and the assembly is finished by putting in place the end pieces 8 and 9.

FIGS. 3 and 4 show possibilities for creating "visual obstruction" walls consisting of four rectangular panels, the wall of FIG. 3 possibly having for example a height of 1 meter, and the wall of FIG. 4 a height of 2 meters tall.

The invention claimed is:

1. A screen panel designed to be mounted or fixed on a surface, to act as a visual obstruction, comprising a sheet having edges, the sheet being held by the edges in a rigid frame consisting of assembled profiles, wherein the frame comprises two uprights, each able to bear on or attach to a ground surface, and two crosspieces extending between the two uprights and comprised of an upper crosspiece and a lower crosspiece, each upright comprising internally at least one respective upright channel, the upright channel opening towards and housing a respective upright edge of the sheet, the upper crosspiece comprising internally at least one upper crosspiece channel on an upper portion of the upper crosspiece opposite the sheet, each upright being connected to the upper crosspiece by a separate bracket-shaped assembly part, wherein each bracket-shaped assembly part comprises a first arm engaged in the upright channel of a corresponding upright, and a second arm perpendicular to the first arm engaged in the upper crosspiece channel, a thickness of the first arm of the assembly part entering the upright channel or a thickness of the second arm of the assembly part entering the upper crosspiece channel being greater than 1.02 times a width of the upright or upper crosspiece channel, respectively, such that the corresponding arm of the assembly part is force-fitted into the upright or upper crosspiece channel, respectively.

2. The screen panel as claimed in claim 1, wherein the profiles forming the uprights and/or the upper crosspiece are made in one piece by bending a metal sheet so as to create the upright channel and/or the upper crosspiece channel.

3. The screen panel as claimed in claim 1, wherein the crosspieces and the uprights are each made of a same hollow profile.

4. The screen panel as claimed in claim 1, wherein the crosspieces are made of profiles having an H having two crosspiece channels in line with one another.

5. The screen panel as claimed in claim 1, wherein each of the uprights comprises a lower ground-bearing end piece, which is snap-fitted to an end of an upright, and an upper sealing end piece that is snap-fitted to an opposite end of the upright.

6. The screen panel as claimed in claim 1, wherein the sheet is made of plastic material.

7. The screen panel as claimed in claim 1, wherein the upright channel and/or the upper crosspiece channel allows expansion of said sheet and is defined by elastically deformable walls.

8. The screen panel as claimed in claim 1, wherein the frame is metallic.

9. The screen panel as claimed in claim 1, wherein the crosspieces each comprise two crosspiece channels and/or the uprights each comprise three upright channels.

10. The screen panel as claimed in claim 1, wherein at least one assembly part has a thickness of less than 15 mm.

11. The screen panel as claimed in claim 1, wherein at least one assembly part does not project out from the upright channel and from the upper crosspiece channel into which the assembly part is inserted or projects therefrom only by a rib connecting the first arm and the second arm of the assembly part.

12. The screen panel as claimed in claim 1, wherein at least one assembly part is formed so as to fill a part of the upright channel of the corresponding upright which extends on a side opposite the sheet with respect to the crosspiece.

13. The screen panel as claimed in claim 1, comprising neither screws nor nails for fixing the sheet to the uprights and/or to the crosspieces, fitting the sheet to an upright requiring no part other than the crosspieces and the said each bracket-shaped assembly part, a lower ground-bearing end piece attached to an end of the upright, and an upper sealing end piece attached to an opposite end of the upright.

14. The screen panel as claimed in claim 1, wherein at least one assembly part is formed such that the first arm of the assembly part engaged in the upright channel of the corresponding upright acts as a spacer, to ensure a predetermined distance between the crosspiece and an end of the upright close to said crosspiece.

15. The screen panel as claimed in claim 1, in which the end face of a crosspiece and/or of an upright at least partially faces the side wall of an upright and/or of a crosspiece respectively, and is at a distance of less than 10 mm from the upright and/or from the crosspiece respectively.

16. A screen comprising at least two, or even at least three, or even at least four, or even at least five, screen panels as claimed in claim 1 and interconnected in pairs.

17. The screen as claimed in claim 16, in which at least two, or even at least three, or even at least four, or even at least five, or even all constituent screen panels are arranged in one and same plane.

18. The screen panel as claimed in claim 1, comprising a lower ground-bearing end piece attached to a lower end of the upright and formed so as to prevent, along with the assembly part connecting the lower crosspiece with the upright, any movement of the lower crosspiece toward the lower ground-bearing end piece, and an upper sealing end piece attached to an upper end of the upright and formed so as to prevent, along with the assembly part connecting the upper crosspiece with the upright, any movement of the upper crosspiece toward the upper sealing end piece.

19. The screen as claimed in claim 1, in which the first arm and the second arm are formed so as to be flush with openings of the upright channel and of the upper crosspiece channel into which each arm is respectively inserted.

20. The screen panel as claimed in claim 1 comprising, for each of the uprights, a lower ground-bearing end piece attached to an end of the upright and comprising attachment orifices designed to receive attachment screws.

21. The screen panel as claimed in claim 1, in which the first arm of the bracket-shaped assembly part engaged in the upright channel of the corresponding upright is housed in a part of said upright channel which extends on a side opposite the sheet with respect to the crosspiece.

* * * * *